US007231154B2

(12) United States Patent
Sakamaki

(10) Patent No.: US 7,231,154 B2
(45) Date of Patent: Jun. 12, 2007

(54) DEVELOPING APPARATUS

(75) Inventor: Tomoyuki Sakamaki, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 81 days.

(21) Appl. No.: 11/087,514

(22) Filed: Mar. 24, 2005

(65) Prior Publication Data

US 2005/0214001 A1 Sep. 29, 2005

(30) Foreign Application Priority Data

Mar. 26, 2004 (JP) ..... 2004-093860

(51) Int. Cl.
*G03G 15/08* (2006.01)

(52) U.S. Cl. ..... 399/27; 399/53; 399/238

(58) Field of Classification Search ..... 399/27, 399/259, 260, 58
See application file for complete search history.

(56) References Cited

U.S. PATENT DOCUMENTS 5,430,532 A * 7/1995 Ueda et al. ..... 399/263
6,850,722 B2 2/2005 Sakemi et al. ..... 399/223
2005/0214001 A1 9/2005 Sakamaki ..... 399/27

FOREIGN PATENT DOCUMENTS

JP 2-21591 1/1990

* cited by examiner

*Primary Examiner*—David M. Gray
*Assistant Examiner*—Bryan Ready
(74) *Attorney, Agent, or Firm*—Fitzpatrick, Cella, Harper & Scinto

(57) ABSTRACT

A developing apparatus includes a developing container for containing a developer. An amount of the developer in the developing container is 100–2000 (g), and an angle of rest of the developer in said developing container is 20–70 (°). When the developing apparatus develops an electrostatic image having an image density of 100(%), an amount A (g) of the developer in the developing container at the time when a difference between a carrier supply amount per unit time by the supplying device and a carrier discharging amount per unit time through the discharging outlet becomes 5(g/min) or less, and an amount B (g) of the developer in the developing container at the time the carrier discharging amount per unit time becomes 0.5(g/min) or less when said developing apparatus operates without supply of the carrier by said supplying means, satisfy $$0.01<(A-B)/A<0.10.$$

7 Claims, 8 Drawing Sheets

DEVELOPING APPARATUS

FIELD OF THE INVENTION AND RELATED ART

The present invention relates to a developing apparatus which uses an electrophotographic recording method, an electrostatic recording method, or the like, to form a visible image by developing an electrostatic latent image formed on an image bearing member. In particular, it relates to a developing apparatus which uses two-component developer containing primarily toner and carrier.

In the field of an image forming apparatus employing an electrophotographic or electrostatic recording method, in particular, a color image forming apparatus which forms a full-color image, a multicolor image, or the like, with the use of an electrophotographic recording method, two-component developer has been used by virtually all developing apparatuses, from the standpoint of color generation and color mixture.

The developing method which uses two-component developer is as follows as it has been known. That is, toner is electrically charged by the friction between the carrier and toner, and a visible image is formed by electrostatically adhering the electrostatically charged toner to a latent image. In order to form an image which is satisfactory in that it is highly durable and fast in color, it is essential to ensure that toner is consistently given a proper amount of triboelectricity (which hereinafter may be referred to simply as tribo), and in order to ensure that toner is consistently given a proper amount of tribo, carrier must be durable and stable in terms of its capability to frictionally charge toner.

In reality, however, the performance of carrier in terms of its capability to frictionally charge toner gradually reduces, for the following reason. That is, toner is gradually consumed by the development process, whereas carrier is not consumed, remaining in a developing apparatus. With the elapse of time (as cumulative length of time carrier is in use increases), the surfaces of carrier particles are contaminated by the external additive and/or toner which adheres the surfaces of the carrier particles as developer is stirred while it is in use. As a result, carrier is reduced in its capability to give tribo to toner. Therefore, toner is not given a proper amount of tribo. When toner is not given a proper amount of tribo, the problem that toner scatters, and/or that an image suffering from fog, or the like problem, is formed, occurs.

As for the means for dealing with the above described problems, that is, the means for preventing the deteriorated developer, that is, the developer with an expired service life, from being used for image formation, it has been a common practice for a service person or the like to replace the developer in a developing apparatus with a fresh supply of developer during regular maintenance. This method, however, has its own problem in that the length of the service life of developer becomes one of the primary factors which determines the length of the service interval.

From the standpoint of the workload of a service person, cost, and also, the length of the downtime of an image forming apparatus, the maintenance interval is desired to be as long as possible. Thus, a large amount of time and effort has been spent to develop developer with a longer service life, and processes for preventing the developer deterioration. However, the reality is that at the time of this writing, the length of the service life of developer is equivalent to 30,000–50,000 copies.

Thus, there has been proposed a developing apparatus of the so-called trickle development type, that is, a developing apparatus which can be replenished with developer to prevent the developer in the developing apparatus from deteriorating in the toner charging performance. As for the working of a developing apparatus of this type, a developing apparatus is provided with an apparatus which supplies the developing apparatus with developer or carrier, and the developer overage resulting from the addition of developer or carrier is recovered by allowing the developer to overflow through the developer outlet, with which one of the walls of the developing apparatus (for example, Japanese Patent Application Publication 2-21591) is provided.

In other words, the deteriorated developer in a developing apparatus of this type is gradually replaced by a fresh supply of developer, that is, a mixture of toner and carrier, through the continual repetition of the process of supplying the apparatus with a fresh supply of developer or carrier and the process of discharging the developer. Therefore, the developer in the developing apparatus is kept stable in properties, that is, toner charging performance, being therefore prevented from contributing to the formation of an image of low quality. Thus, the employment of this structural arrangement makes it possible to reduce a developing apparatus in the frequency with which the developer in the developing apparatus is replaced in entirety by a service person or the like, that is, to extend the length of the developer replacement interval, or even to eliminate the need for a service person or the like to replace the developer in the developer with a fresh supply of developer during regular maintenance.

As for the method, used in the trickle developing method, for replacing the deteriorated carrier with a fresh supply of carrier, there has been proposed a developing apparatus with a mechanism which supplies the developing apparatus only with carrier. However, the most widely used method is the method which replaces the deteriorated carrier with a fresh supply of carrier by supplying the developing apparatus, at predetermined intervals or continuously, with replenishment developer, that is, a mixture of toner and carrier, instead of pure toner, when supplying the developing apparatus with toner. This method does not require a developing apparatus to be provided with a carrier supplying mechanism, that is, an additional mechanism, being therefore advantageous from the standpoint of cost and space.

This structural arrangement, however, has the following problem.

That is, normally, the amount by which a developing apparatus is supplied with toner is controlled to keep an image forming apparatus stable in terms of the toner density in which an image is formed. Thus, the amount by which toner is supplied to a developing apparatus is varied in accordance with the amount of toner consumption, in other words, the image density of an original from which copies are made. Thus, in the case of a developing apparatus employing the trickle developing method which supplies the developing apparatus with the above mentioned replenishment developer, that is, mixture of toner and carrier, the amount by which a developing apparatus is supplied with carrier also continuously changes.

If a developing apparatus employing the trickle developing method is structured so that the deteriorated developer is quickly recovered from the developing apparatus by the amount equal to the amount by which the developing apparatus is supplied with a fresh supply of developer, the amount of the developer in the developing apparatus remains stable. However, in the case of a developing apparatus employing the trickle developing method in accordance with the prior art, it takes a substantial length of time for the developer overage to be discharged. Therefore, when the developing apparatus is supplied with a large amount of replenishment developer, the rate at which the developer overage is discharged cannot immediately keep up with the rate at which the replenishment developer is supplied, causing the amount of the developer in the developing apparatus to increase. Therefore, the developing apparatus does not stabilize in the amount of the developer therein. As the amount of the developer in the developing apparatus increases, the body of the developer in the developing apparatus changes in the position of its top surface. However, in order to keep a developing apparatus (image forming apparatus) stable in image quality, it is necessary for the body of developer in the developing apparatus to be stable in the position of its top surface for the following reason. That is, if the top surface of the body of developer in the developing apparatus rises or falls, the developing apparatus (image forming apparatus) is likely to become inconsistent in the amount by which toner is given tribo, becoming thereby inconsistent in image density, because if it rises, the freshly supplied developer fails to be sufficiently stirred, whereas if it falls, the developer in the developing apparatus increases in toner density.

It is normal that the top surface of the body of developer in the developing apparatus sometimes changes in position, in terms of the vertical direction, due to the change in the apparent density of developer attributable to the change in the amount of tribo resulting from the carrier deterioration resulting from usage, and/or changes in ambience. In comparison, the changes in the position of the top surface of the body of developer in the developing apparatus, attributable to the above described changes in the image density of an original or an intended image, is more sudden than those attributable to the changes resulting from the changes which occur to the developer due to usage, or changes in ambience. Therefore, the image defects attributable to the changes in the position of the top surface of the body of developer in the developing apparatus, attributable to the changes in the density of an original or an intended image, are very conspicuous. Thus, it is very difficult to adjust the developing apparatus in this respect.

This problem is more damaging to a color image forming apparatus, because a color image forming apparatus is higher in image density, being therefore greater in the amount by which its developing apparatuses are supplied with replenishment developers. Therefore, in the case of a color image forming apparatus, it is even more important to quickly recover the deteriorated developer from the developing apparatuses by the amount equal to the amount by which the developing apparatuses are supplied with replenishment developers, so that the developing apparatuses remain stable in the amount of the developer therein.

The inventors of the present invention carried out a large number of studies and experiments for solving the above described problems, while taking into consideration the abovementioned circumstances. As a result, they reached the conclusion that in order to solve the above described problems, it is necessary to stabilize a developing apparatus in terms of the position of the top surface of the body of developer in the developing apparatus, and that a developing apparatus can be stabilized in terms of the position of the top surface of the body of developer therein by controlling the developing apparatus and the replenish developer with which the developing apparatus is supplied so that a predetermined relationship is maintained between the changes in the amount of the developer in the developing apparatus, and the amount of the developer in the developing apparatus. The present invention was made based on the new discovery made by the inventors of the present invention.

SUMMARY OF THE INVENTION

The primary object of the present invention is to provide a developing apparatus which employs the developing method, in accordance with the prior art, in which the deteriorated developer is discharged while the developing apparatus is supplied with replenishment developer, that is, mixture of toner and carrier, and yet, is free of the problem that the freshly supplied developer is not sufficiently stirred and/or nonuniformly mixed with the body of developer in the developing apparatus, always yielding thereby images of high quality.

According to an aspect of the present invention, there is provided a developing apparatus for developing an electrostatic image formed on an image bearing member, said developing apparatus comprising a developing container for accommodating a developer including toner and carrier; developer stirring means provided in said developing container; a developer carrying member for carrying the developer to an opposing portion where said developer carrying member is opposed to said image bearing member; supplying means for supplying a developer including toner and carrier into said developing container; discharging means for discharging the developer from said developing container; supply control means for controlling a supplying operation of said supplying means to control a toner content in the developer in said developing container, wherein an amount of the developer A (g) in said developing container when a difference between an amount of the carrier supplied by said supplying means per unit time and an amount of discharge of the carrier by said discharging means per unit time becomes not more than 5 (g/min) during development of an electrostatic image having an image density of 100%, and an amount of the developer in said developing container B (g) when an amount of discharge of the carrier per unit time becomes not more than 0.5 (g/min) without the supply of the carrier from said supplying means, satisfy $0.01 \leqq (A-B)/A \leqq 0.10$.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the image forming apparatus in accordance with the present invention will be described with reference to the appended drawings.

Embodiment 1

Figure 1:
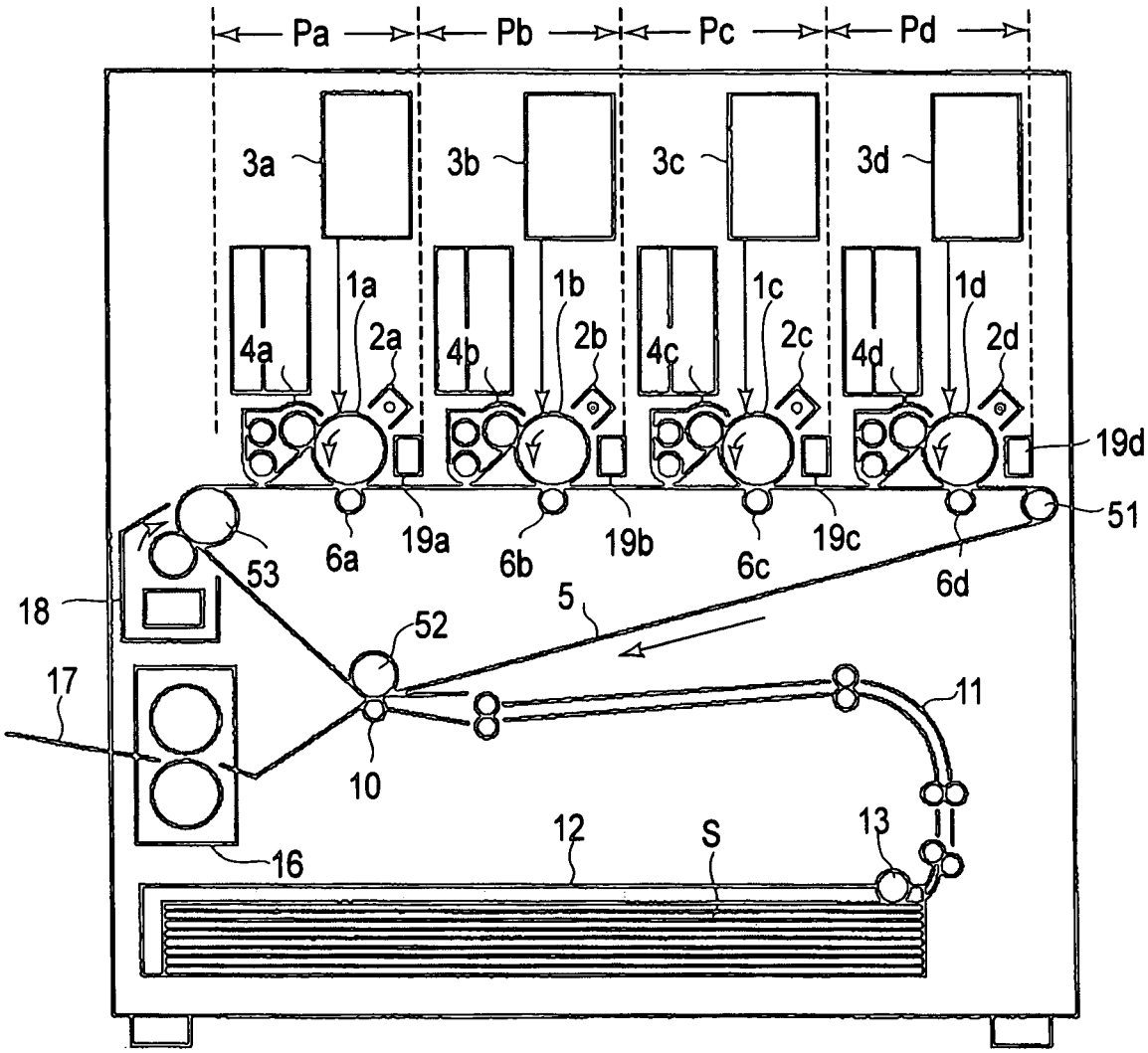
FIG. 1 is a schematic drawing of the image forming apparatus in the first embodiment of the present invention, showing the general structure thereof.

FIG. 1 is a schematic drawing of the electrophotographic full-color image forming apparatus, as an example of an image forming apparatus to which the present invention is applicable, showing the general structure thereof.

The image forming apparatus in this embodiment has four image forming portions P (Pa, Pb, Pc, and Pd). Each of the four image forming portions Pa—Pd has a photosensitive drum, that is, an electrophotographic photosensitive member as an image bearing member, in the form of a drum, which rotates in the direction indicated by an arrow mark (counterclockwise direction). Each image forming portion P has an image forming means comprising a charging device 2 (2*a*, 2*b*, 2*c*, and 2*d*), a laser beam scanner 3 (3*a*, 3*b*, 3*c*, and 3*d*) as an exposing means disposed above the photosensitive drum 1, in the drawing, a developing apparatus 4 (4*a*, 4*b*, 4*c*, and 4*d*), a transfer roller 6 (6*a*, 6*b*, 6*c*, and 6*d*), a cleaning means 19 (19*a*, 19*b*, 19*c*, and 19*d*), etc. These components are disposed in the adjacencies of the peripheral surface of the photosensitive drum 1 in a manner of surrounding the photosensitive drum 1.

The four image forming portions Pa, Pb, Pc, and Pd are identical in structure. In other words, the photosensitive drums 1*a*, 1*b*, 1*c*, and 1*d* of the image forming portions Pa, Pb, Pc, and Pd, respectively, are identical in structure. Therefore, the photosensitive drums 1*a*, 1*b*, 1*c*, and 1*d* will be referred to as photosensitive drum 1 in general terms. Similarly, the charging devices 2*a*, 2*b*, 2*c*, and 2*d*, laser beam scanners 3*a*, 3*b*, 3*c*, and 3*d*, developing apparatuses 4*a*, 4*b*, 4*c*, and 4*d*, transfer rollers 6*a*, 6*b*, 6*c*, and 6*d*, cleaning means 19*a*, 19*b*, 19*c*, and 19*d*, and the like image forming means, of the image forming portions Pa, Pb, Pc, and Pd, respectively, are identical in structure. Therefore, the charging devices 2*a*, 2*b*, 2*c*, and 2*d*, laser beam scanners 3*a*, 3*b*, 3*c*, and 3*d*, developing apparatuses 4*a*, 4*b*, 4*c*, and 4*d*, transfer rollers 6*a*, 6*b*, 6*c*, and 6*d*, cleaning means 19*a*, 19*b*, 19*c*, and 19*d*, and the like image forming means, of the image forming portions Pa, Pb, Pc, and Pd, will be referred to as charging device 2, laser beam scanner, 3, developing apparatus 4, transfer roller 6, and cleaning means 19, respectively, in general terms.

Next, the image formation sequence of the image forming apparatus structured as described above will be described.

First, the photosensitive drum 1 is uniformly charged by the charging device 2. The photosensitive drum 1 is rotated in the clockwise direction indicated by an arrow mark at a process speed (peripheral velocity) of 273 mm/sec.

After being uniformly changed as described above, the photosensitive drum 1 is scanned by a beam of laser light projected, while being modulated with video signals, from the above-mentioned laser beam scanner 3, which internally holds a semiconductor laser. The semiconductor laser is controlled by the video signals modulated with image formation data outputted by an original reading apparatus having an photoelectric transducer such as a CCD, and outputs a beam of laser light.

As the peripheral surface of the photosensitive drum 1 uniformly charged by the charging device 2 is scanned as described above, the numerous points of the peripheral surface of the photosensitive drum 1 change in potential level. As a result, an electrostatic latent image is effected on the peripheral surface of the photosensitive drum 1. This electrostatic latent image is developed in reverse into a visible image, that is, an image formed of toner (which hereinafter will be referred to as toner image).

In this embodiment, the developing apparatus 4 employs the two-component developing method of the contact type, which uses a mixture of toner and carrier, as developer.

The above described image formation sequence is carried out by each of the image forming portions Pa, Pb, Pc, and Pd. As a result, four images are formed of yellow, magenta, cyan and black toners, on the photosensitive drums 1*a*, 1*b*, 1*c*, and 1*d*, respectively.

In this embodiment, the image forming apparatus is provided with an intermediary transferring member 5, which is in the form of a belt (intermediary transfer belt), which is located below the image forming portions Pa, Pb, Pc, and Pd. The intermediary transfer belt 5 is wrapped around rollers 51, 52, and 53, being suspended by them, and is rotatable in the direction indicated by an arrow mark.

The toner images on the photosensitive drums 1 (1*a*, 1*b*, 1*c*, and 1*d*) are temporarily transferred by the transfer rollers 6 (6*a*, 6*b*, 6*c*, and 6*d*) as a primary transferring means, respectively, onto the intermediary transfer belt 5 as an intermediary transfer member. As a result, four toner images, that is, yellow, magenta, cyan, and black toner images, are deposited in layers on the intermediary transfer belt 5, effecting thereby a full-color image on the intermediary transfer belt 5. As for the toner remaining on the photosensitive drum 1, that is, the toner which was not transferred onto the intermediary transfer belt 5, it is recovered by the cleaning means 19.

The full-color image on the intermediary transfer belt 5 is transferred onto a recording medium S such as a piece of paper. More specifically, the transfer medium S is drawn out of a sheet feeder cassette 12 by a feed roller 13, and is conveyed to the image transfer portion along a sheet guide 11. Then, as the recording medium S is conveyed through the image transfer portion, the full-color image is transferred onto the recording medium S by the function of a secondary transfer roller 10 as a secondary transferring means. The toner remaining on the surface of the intermediary transfer belt 5, that is, the toner which was not transferred onto the recording medium S, is recovered by a cleaning means 18 for cleaning the intermediary transfer belt 5.

As for the transfer medium S onto which the toner images were transferred, it is sent to a fixing device 15 (fixing device of thermal roller type), in which the toner images are fixed to the recording medium S. Thereafter, the recording medium S is discharged into a delivery tray 17.

Incidentally, although, in this embodiment, the photosensitive drum 1, which is an ordinary organic photosensitive member in the form of a drum, is used as an image bearing member, an inorganic photosensitive member such as a photosensitive member based on amorphous silicon or the like may be used as an image bearing member, which is obvious. Further, it is possible to use a photosensitive member in the form of a belt.

As for the charging method, transferring method, cleaning method, and fixing method, they also do not need to be limited to those described above.

Figure 2:
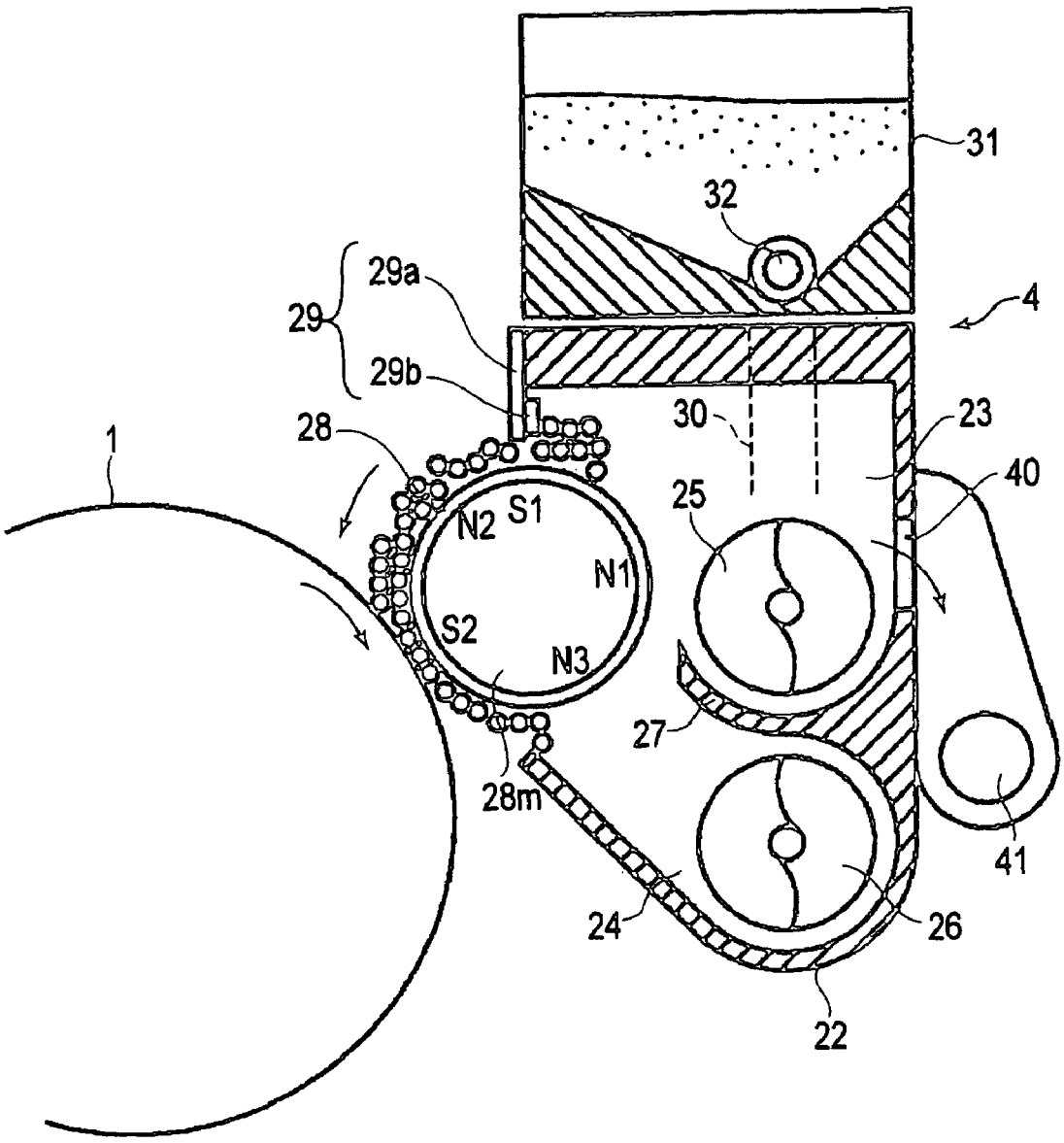
FIG. 2 is a sectional view of the developing apparatus, at a plane perpendicular to its lengthwise direction.
Figure 3:
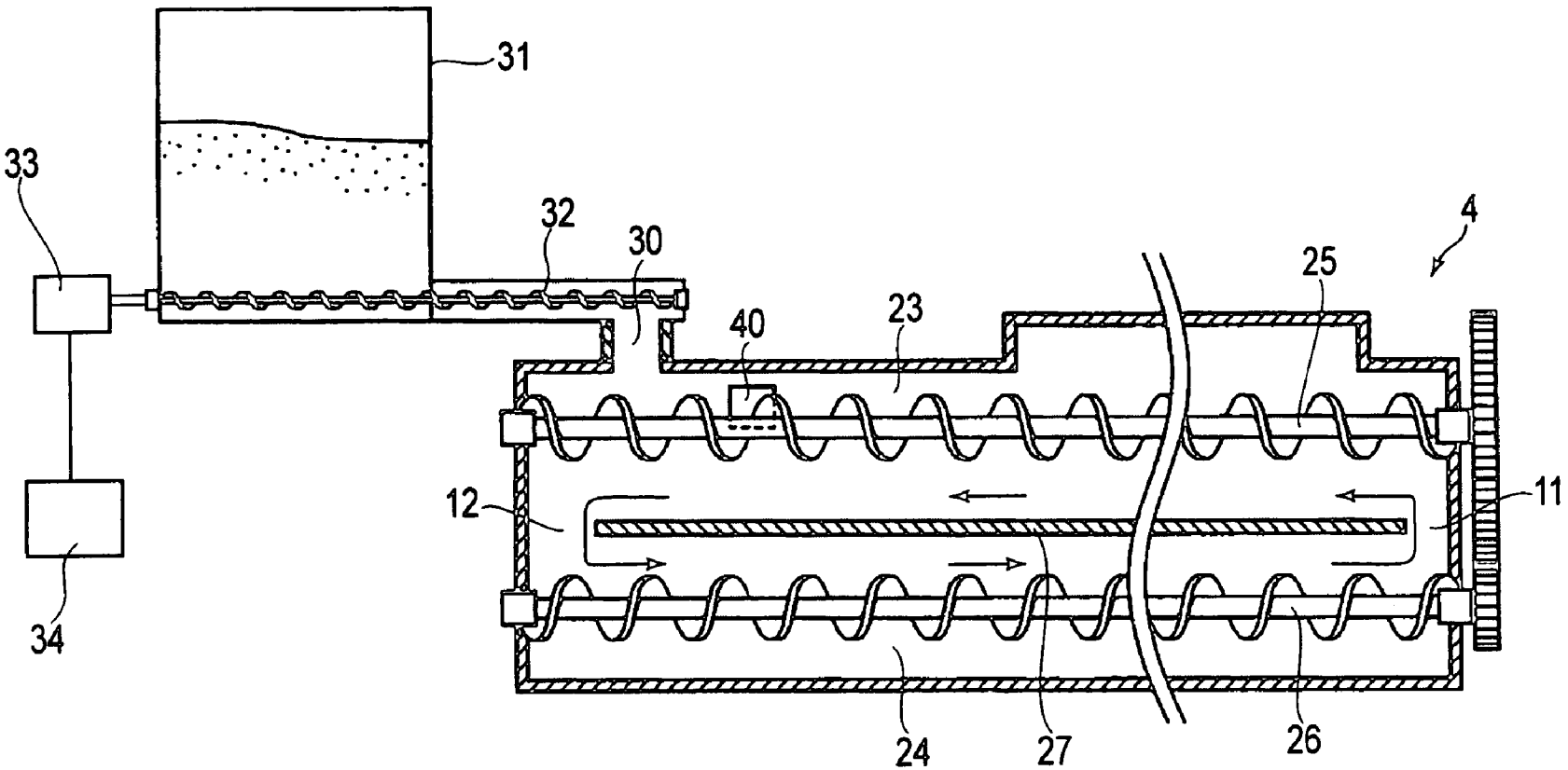
FIG. 3 is a sectional view of the developing apparatus, at a plane parallel to its lengthwise direction.

Next, referring to FIGS. 2 and 3, the operation of the developing apparatus 4 will be described. FIGS. 2 and 3 are sectional views of the developing apparatus 4 in this embodiment.

The developing apparatus 4 in this embodiment has a developer container 22, in which two-component developer made up primarily of toner and carrier is stored. The developing apparatus 4 also has a development sleeve 28 as a developer bearing member, and a trimming member 29 for regulating the magnetic brush formed of the developer borne on the peripheral surface of the development sleeve 28. The development sleeve 28 and trimming member 29 are disposed in the developer container 22.

In this embodiment, the internal space of the developer container 22 is horizontally divided by a partitioning wall 27, into a development chamber 23, that is, the top chamber, and stirring chamber 24, that is, the bottom chamber. Referring to FIG. 2, the partitioning wall 27 extends in the direction perpendicular to the drawing. Referring to FIG. 3, the partitioning wall extends from one lengthwise end of the developer container 22 to the other, with the presence of a predetermined gap between the partitioning wall 27 and corresponding end wall of the developer container 22, at each lengthwise end of the developer container 22. The developer is stored in the development chamber 23 as well as the stirring chamber 24.

In the development chamber 23 and stirring chamber 24, first and second conveyance screws 25 and 26, as means for conveying developer while stirring it, are disposed, respectively. The first conveyance screw 25 is disposed in the bottom portion of the development chamber 23, roughly in parallel to the axial direction of the development sleeve 28. It conveys the developer in the development chamber 23 in one direction parallel to the axial line of the development sleeve 28 by being rotated. The second conveyance screw 26 is disposed in the bottom portion of the stirring chamber 24, roughly in parallel to the conveyance screw 26. It conveys the developer in the stirring chamber 24 in the direction opposite to the direction in which the developer in the development chamber 23 is conveyed by the conveyance screw 25. With the first and second conveyance screws 25 and 26 conveying the developer as described above, the developer in the developer container 22 is circulated between the development chamber 23 and stirring member 24 through the aforementioned gaps 11 and 12 (that is, developer passages) present between the lengthwise ends of the partitioning wall 27 and the corresponding end walls of the developer container 22, one for one.

In this embodiment, the development chamber 23 and stirring chamber 24 are vertically stacked. However, the present invention is also applicable to developing apparatuses different in the positioning of the development chamber 23 and stirring chamber 24 from the developer container 22 in this embodiment, for example, the developing apparatuses which have been widely in use, and in which the development chamber 23 and stirring chamber 24 are placed side by side.

Also in this embodiment, the developer container 22 is provided with an opening (hole), which faces the development area (where photosensitive drum 1 is present). The development sleeve 28 is rotatably attached to the developer container 22, being partially exposed from the developer container 22 toward the photosensitive drum 1 through this opening.

The diameters of the development sleeve 28 and photosensitive drum 1 are 20 mm and 80 mm, respectively, and the smallest distance between the peripheral surfaces of the development sleeve 28 and photosensitive drum 1 is set to be roughly 40 μm so that a latent image on the peripheral surface of the photosensitive drum 1 can be developed by placing the layer of developer on the peripheral surface of the development sleeve 28 in contact with the peripheral surface of the photosensitive drum 1 as the layer of developer on the development sleeve 28 is conveyed into the developing portion. The development sleeve 28 is formed of nonmagnetic substance such as aluminum and stainless steel. It internally holds a magnetic roll 28*m* as a magnetic field generating means, which is non-rotationally disposed within the hollow of the magnetic roll 28*m*. This magnetic roll 28*m* has a development pole S2 facing the portion of the photosensitive drum 1 in the developing portion, a magnetic pole S1 facing the magnetic brush trimming member 29, a magnetic pole N1 positioned between the magnetic poles S1 and S2, and magnetic poles N2 and N3 facing the development chamber 23 and stirring chamber 24, respectively.

While the development process is carried out, the development sleeve 28 is rotated in the direction indicated by an arrow mark (counterclockwise direction). As the development sleeve 28 is rotated, the two-component developer in the development chamber 23 is borne on the peripheral surface of the development sleeve 28, and is carried to the aforementioned magnetic brush trimming member 29, by which the body of the two-component developer on the peripheral surface of the development sleeve 28 is regulated in its thickness. Then, the body of two-component developer uniform in thickness is conveyed by the rotation of the development sleeve 28 to the development area in which the distance between the peripheral surfaces of the development sleeve 28 and photosensitive drum 1 is smallest. As a result, the two-component developer on the peripheral surface of the development sleeve 28 is supplied to the peripheral surface of the photosensitive drum 1 in the pattern of the electrostatic latent image on the peripheral surface of the photosensitive drum 1; the latent image is developed. During this process of developing the latent image, in order to improve developmental efficiency, that is, the efficiency with which the developer is transferred onto the peripheral surface of the photosensitive drum 1 in the pattern of the latent image, development bias, which is a combination of DC voltage and AC voltage, is applied to the development sleeve 28 from the electrical power source. In this embodiment, the development bias is the combination of a DC voltage of −500 V, and an AC voltage which is 1,800 V in peak-to-peak voltage and 12 kHz in frequency. However, the voltage value of DC voltage and waveform of AC voltage do not need to be limited to those described above.

In the developing method based on a magnetic brush formed of two-component developer, generally, the application of AC voltage raises development efficiency, improving thereby an image forming apparatus in image quality. On the other hand, it is likely to cause an image forming apparatus to yield an image suffering from fog. Therefore, the potential level of the DC voltage applied to the development sleeve 28 is made different from the potential level to which the photosensitive drum 1 is charged (that is, potential level of blank area) in order to prevent the formation of an image suffering from fog.

The regulating blade 29 as the above-mentioned trimming member is made up of a nonmagnetic portion 29*a*, and a magnetic portion 29*b*. The nonmagnetic portion 29*a* is formed of a piece of aluminum plate or the like and extends in the direction parallel to the axial direction, that is, lengthwise direction, of the development sleeve 28. The magnetic portion 29*b* is formed of iron or the like substance, and extends in the same direction as the nonmagnetic portion 29*a*. The regulating blade 29 is disposed upstream of the photosensitive drum 1 in terms of the rotational direction of the development sleeve 28. Both the toner and carrier of the developer are sent to the development area through the gap between the edge of the trimming member 29 and the peripheral surface of the development sleeve 28. The amount by which the developer is conveyed to the development area is adjusted by the amount of the gap between the regulating blade 29 and the peripheral surface of the development sleeve 28. In other words, the amount by which the developer is conveyed to the development area is adjusted by adjusting the amount by which the body of the developer (magnetic brush) borne on the peripheral surface of the development sleeve 28 is trimmed by the trimming member 29. In this embodiment, the amount per unit area, by which the developer is coated on the peripheral surface of the development sleeve 28 is regulated to 30 mg/cm$^2$ by the regulating blade 29.

The gap between the regulating blade 29 and development sleeve 28 is desired to be set to a value in the range of 200–1,000 μm, preferably, 400–700 μm. In this embodiment, it is set to 600 μm.

The development sleeve 28 of the developing apparatus 4, and the photosensitive drum 1, are driven in the directions so that their peripheral surfaces move in the same direction in the development area. As for the ratio of the peripheral velocity of the development sleeve 28 relative to that of the photosensitive drum 1, it is set to 1.75. It does not need to be set to 1.75, as long as it is set to a value in the range of 0–3.0, preferably, 0.5–2.0. The greater the ratio, the higher the development efficiency. However, when it is greater than a certain value, such problems as that toner scatters, and/or that developer is deteriorated faster, occur. Therefore, it is desired to be set to a value in the abovementioned range.

Next, the two-component developer used in this embodiment, which comprises primarily toner and carrier, will be described.

The toner contains primarily bonding resin, and coloring agent. If necessary, particles of coloring resin, inclusive of additives, and coloring particles having external additive such as microscopic particles of choroidal silica, are added to the developer. The toner used in this embodiment is resinous toner formed of polyester or the like, and is desired to be no less than 4 μm, and no more than 10 μm, preferably, no more than 8 μm, in volume average particle diameter.

As for the material for the carrier, iron particles, the surface of which has been oxidized, iron particles, the surface of which has not been oxidized, nickel, cobalt, manganese, chrome, rare-earth metals, alloys of the preceding metals, or ferrous oxide, are preferable. The method for manufacturing the magnetic particles is optional. The weight average particle diameter of the carrier is desired to be in the range of 20–60 μm, preferably, 30–50 μm. The carrier is desired to be no less than $10^7$ ohm.cm, preferably, no less than $10^8$ ohm.cm, in resistivity. In this embodiment, the carrier with a resistivity of $10^8$ ohm.cm is used.

The volume average particle diameter of the toner used in this embodiment was measured using the following apparatus and method. As the measuring apparatus, a Coulter Counter T-II (product of Coulter Co. Ltd.), and an interface (product of Nikkaki Co.) for outputting number average distribution and volume average distribution, were used. As the electrolytic solution, 1% water solution of first class sodium chloride was used.

The measuring method was as follows: To 100–150 ml of the abovementioned water solution of electrolyte, 0.1 ml of surfactant as dispersant, preferably, alkyl-benzene-sulfonate, was added, and to this mixture, 0.5–50 mg of test sample was added.

Then, the water solution of the electrolyte, in which the test sample was suspended, was placed in an ultrasonic dispersing device for roughly 1–3 minutes to disperse the test sample. Then, the particle size distribution of the toner particles, the size of which is in the range of 2–40 μm was measured with the use of the abovementioned Coulter Counter TA-II fitted with a 100 μm aperture, and volume average distribution was obtained. Then, volume average particle diameter was obtained from the volume average distribution obtained through the above described process.

The resistivity of the carrier in this embodiment was measured using the following method: The sample was placed in a cell of the sandwich type with an electrode gap of 0.4 cm, and voltage E (V/cm) was applied between the two electrodes while applying 1 kg of weight to one of the electrodes, to obtain the resistivity of the carrier from the amount of the current which flowed through the circuit.

Next, referring to FIGS. 2 and 3, the method, in this embodiment, for replenishing the developing apparatus with developer will be described.

The developing apparatus 4 is provided with a hopper 31 for replenishing the developing apparatus 4 with the replenishment developer, that is, a mixture of toner and carrier. The hopper 31 is located in the top portion of the developing apparatus 4. The hopper 31, which constitutes the toner supplying means, is provided with a conveying member 32 in the form of a screw, which is disposed in the bottom portion of the hopper 31. One end of the conveying member 32 extends to the developer inlet 30 of the developer container 23, which is located near the front end of developing apparatus 4.

The developer container 22 of the developing apparatus 4 is replenished with developer, by the amount equal to the amount of the developer consumed for image formation. More concretely, as the conveying member 32 is rotated, the replenishment is conveyed to the developer inlet 30 of the developer container 22, and then, the falls into the developer container 22 through the developer outlet due to its own weight, replenishing thereby the developer container 22 with toner.

The amount by which the replenishment developer is supplied to the developer container 22 can be roughly controlled by controlling the number of the revolutions of the conveying member 32 (screw) driving by a driving means 33 (for example, motor or the like), and the number of revolutions is controlled by an unshown replenishment developer amount controlling means 34. As for the method for controlling the amount by which the developer is delivered to the developer container 22, it is optional. That is, it may be selected from among the various methods, which have long been known; for example, a method in which the toner density of the two-component developer is optically or magnetically detected, a method in which the density of a toner image formed by developing a referential latent image formed on the peripheral surface of the photosensitive drum is detected, etc.

Next, referring to FIGS. 2 and 3, the method, in this embodiment, for discharging the developer will be described.

The developing apparatus 4 is provided with a developer outlet 40 as a developer discharging means, which is in one of the walls of the developing apparatus 4. The deteriorated developer is discharged in the direction indicated by an arrow mark through this developer outlet 40. As the amount of the developer in the developing apparatus 4 increases due to the execution of the process of replenishing the developing apparatus 4 with the replenishment developer to replenish the developing apparatus 4 with replenishment developer, the developer in the developer container 22 is discharged, that is, allowed to overflow, through the developer outlet 40 by the amount proportional to the amount of the increase. The discharged developer is conveyed by a recovery screw 41 as a conveying means to an unshown storage bin for the recovered developer.

As for the positioning of the developer outlet 40, the developer outlet 40 is located upstream of the developer inlet 30 of the developer container 22, in order to prevent the fresh supply of replenishment developer from being immediately discharged. In consideration of the benefits of the trickle developing method, the fresh supply of replenishment developer is desired to be prevented from being immediately discharged. However, preventing the fresh supply of replenishment developer from being immediately discharged makes it difficult for the developer in the developer container 22 to be speedily discharged by the amount equal to the amount by which the replenishment developer is supplied, which often results in the problems described in the preceding section of this specification regarding the problem to be solved.

At this time, the relationship between the amount by which the carrier in the developer is discharged, and the amount of the developer in the developer container, will be described.

Figure 4:
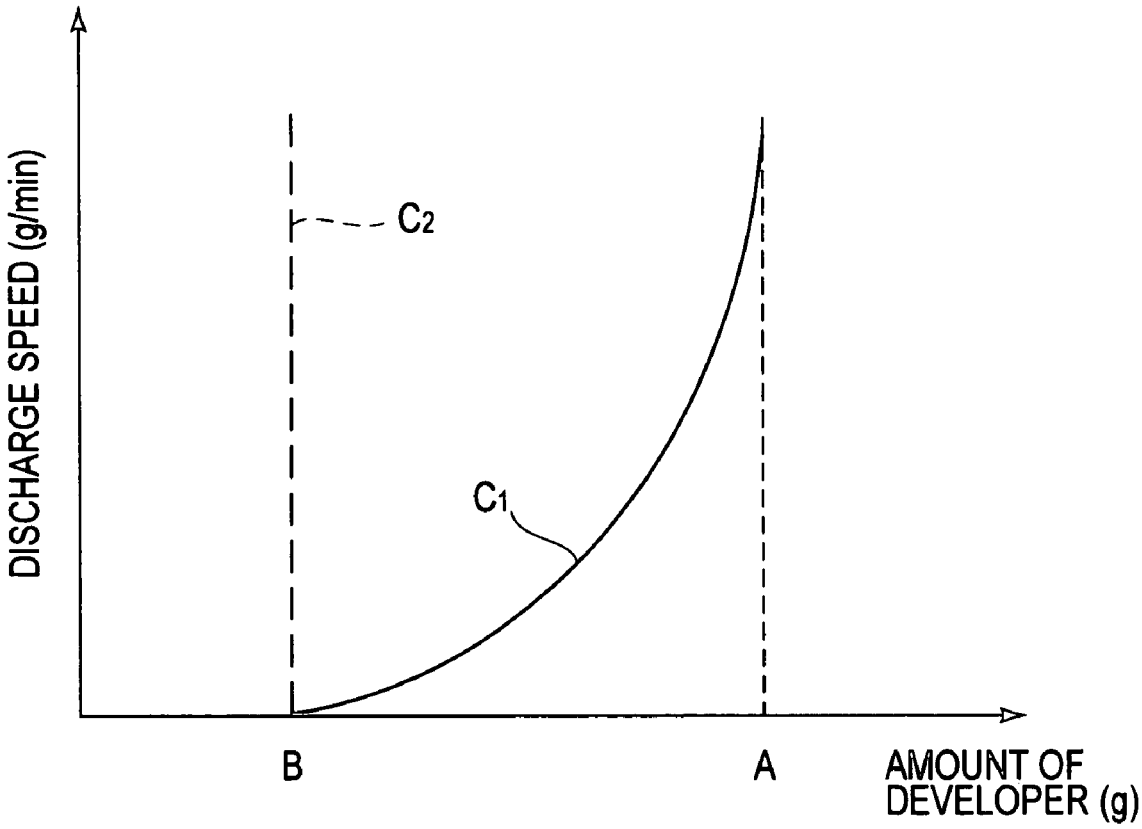
FIG. 4 is a graph showing the relationship between the amount of the developer in the developing apparatus, and rate of developer discharge.

FIG. 4 is a graph diagramatically showing the relationship between the changes in the amount of the developer in the developer container, and changes in the speed at which the deteriorated developer was discharged, which were actually measured.

Here, the discharge speed means the amount by which the developer is discharged per unit of time. However, when the developing apparatus is intermittently driven, the discharge speed means the amount by which the developer is discharged per unit of time while the developing apparatus is driven.

The following is evident from the graph in FIG. 4. That is, when the amount of the developer in the developer container is no more than B, virtually no developer is discharged from the developing apparatus 4 through the developer outlet 40. Therefore, the discharge speed, that is, the amount of the developer discharge is virtually zero. In this situation, it may be thought that the top surface of the body of developer in the developer container 22, at the location of the developer outlet 40, roughly coincides with the bottom edge of the developer outlet 40, and therefore, virtually no developer is discharged.

It is assumed that the developer container is supplied with the replenishment developer when the amount of the developer in the developer container 22 is as described. As the developer container 22 is supplied with the replenishment developer, the top surface of the body of developer in the developer container 22 becomes higher than the bottom edge of the developer outlet 40 of the developer container 22. As a result, the developer overflows through the developer outlet 40 (it is discharged at a certain speed). The greater the excess amount of the developer in the developing apparatus 4, the faster the discharge speed. In other words, the discharge speed is a function C1 of the excess amount of the developer in the developer container 22.

As for the condition in which the replenishment developer is being quickly discharged, it is the condition in which the amount of the developer in the developer container 22 equals the value indicated by the dotted line C2 in the graph in FIG. 4. When the developer container 22 is in this condition (C2 condition), the speed at which the developer is discharged from the developing apparatus 4 is virtually zero. In other words, the developer container 22 is in the condition in which the amount of the developer in the developing apparatus 4 is stable, that is, in the condition in which if the amount of the developer in the developer container 22 increases even by a small amount, the developer is instantly discharged by the amount by which the developer in the developer container 22 was increased, that is, in the condition that if the amount of the developer in the developer container 22 is increased even by a small amount, the discharge speed infinitesimally increases. In other words, this condition can be represented by the line C2, which is virtually vertical.

In reality, however, it is impossible for the entirety of the excess amount of the developer in the developer container 22 to instantly overflow (be discharged). In other words, the discharge speed becomes the function of the excess amount of the developer in the developer container 22, represented by the solid line C1 in the graph in FIG. 4, taking finite values. It is evident from the graph, as well as the above description, that the faster the speed at which the developer is discharged, the smaller the fluctuation in the amount of the developer in the developer container 22.

Next, referring to the graph in FIG. 4, the relationship between the amount by which carrier is supplied, and the amount of the developer in the developer container 22 will be described.

The amount of the developer in the developer container 22 stabilizes when the speed at which the replenishment developer is supplied matches the speed at which the deteriorated developer is discharged. Accurately speaking, the fresh supply of replenishment developer and the developer which is discharged from the developing apparatus 4 do not match in the ratio of the carrier therein, and therefore, the amount of the developer in the developer container 22 roughly stabilizes only when the speed at which carrier is supplied equals the speed at which carrier is discharged. This is due to the following reason. That is, if the amount of the developer in the developing apparatus 4 increases above the value at which it remains stable, the speed at which the developer is discharged increases, making thereby the speed at which the developer is discharged from the developer container 22, faster than the speed at which the replenishment developer is supplied, that is, the speed at which carrier is supplied. As a result, the amount of the developer container 22 returns to the value at which it remains stable. Should the amount of the developer in the developer container 22 reduce, it recovers for the same reason stated above. In other words, the amount of the developer in the developer container remains stable only when it is such an amount that makes the speed at which carrier is discharged from the developing apparatus, equal to the speed at which the developing apparatus is supplied with carrier.

As will be evident from the above explanation, it is when the speed at which carrier is supplied is fastest that the amount of the developer in the developing apparatus 4 becomes largest. This condition coincides with the condition in which the image density of an image to be formed is 100%, that is, when a solid image is formed. That the image density is 100% means that the amount of toner consumption is highest. However, that the amount of toner consumption is highest means that the amount by which toner is supplied, and therefore, the amount by which carrier is supplied, is highest, because, in this embodiment, the developing apparatus 4 is replenished with the mixture of toner and carrier.

On the other hand, when the amount of the developer in the developing apparatus 4 becomes smallest is when the image density is 0%. In other words, the amount of the developer in the developing apparatus 4 varies between the value when the image density is 100% and the value when the image density is 0%.

As will be understood from the above explanation, the amount of the developer in the developing apparatus 4 reaches the maximum amount A when the image density is 100%, that is, when the amount by which carrier is supplied is maximum, whereas it reduces to the minimum amount B when the image density is 0%, that is, when the amount by which carrier is supplied is virtually zero. Therefore, the amount of the fluctuation in the amount of the developer in the developing apparatus 4 is A–B.

The smaller the amount of the fluctuation of (A–B), the more stable the amount of the developer in the developer container 22, and the smaller the variation in the amount of the tribo of the toner. However, it has been discovered through the studies made by the inventors of the present invention that as the criterion for the tribo fluctuation and image density fluctuation, (A–B)/A, that is, the ratio of the amount of fluctuation of the developer amount relative to the developer amount in the developing apparatus is better suited than the amount of the fluctuation of (A–B).

The fluctuation in the amount of the tribo, that is, the problem with which the present invention is concerned, is affected more by the changes in the position of the top surface of the body of the developer in the developer container 22 than by the fluctuation in the amount of the developer in the developer container 22. This means that no matter how much the amount of the developer in the developer container 22 changes, the tribo amount fluctuation attributable to insufficient stirring does not occur, as long as the top surface of the body of the developer in the developer container 22 does not change in position, and on the other hand, even if the amount of the developer in the developer container 22 does not change much, the tribo amount fluctuation attributable to insufficient stirring still occurs as long as the top surface of the body of the developer in the developer container 22 substantially changes in position.

Therefore, as the criterion for the tribo amount fluctuation and image density fluctuation, it is better to use the changes in the position of the top surface of the body of the developer in the developer container 22 than the fluctuation in the amount of the developer in the developer container 22. In comparison to the amount of the fluctuation of (A–B) in the developer container 22, ((A–B)/A), that is, the ratio of the amount of the developer amount fluctuation in the developer container 22 relative to the amount of the developer in the developer container 22, better reflects the changes in the position of the top surface of the body of the developer in the developer container 22, being better as the criterion for the tribo amount changes.

According to the studies made by the inventors of the present invention, it is necessary that (A–B)/A satisfies the following inequality:

$$0.01-(A-B)/A-0.10.$$

In other words, the amount of the developer in the developer container 22 and height of the bottom edge of the developer outlet of the developer container 22 need to be set so that the value of (A–B)/A will fall in the range of 0.01–0.10, preferably, 0.01–0.09, more preferably, 0.01–0.08. If it is greater than 0.10, the change in the position of the top surface of the body of the developer in the developer container 22 is greater, which results in the problem that the developer in the developer container 22 becomes nonuniform in terms of the toner and carrier distribution due to the unsatisfactory stirring of the supplied replenishment developer. Therefore, the image forming apparatus is likely to form defective images.

On the other hand, if the value of (A–B)/A is no more than 0.01, the following problems will occur.

In order to make the value of (A–B)/A smaller, it is necessary for the supplied replenishment developer to be quickly discharged through the developer outlet 40. In order for the supplied replenishment developer to be quickly discharged through the developer outlet 40, the distance between the developer inlet 30 and developer outlet 40 needs to be short. However, if this distance is shorter than a certain value, the freshly supplied replenishment developer is quickly discharged, instead of the deteriorated developer, that is, the developer which should be discharged. This nullifies the benefits of the trickle developing method, which characterizes the present invention.

From the above described standpoint, the location of the developer outlet 40 is desired to be upstream of the location of the developer inlet 30 in terms of the developer conveyance direction. Here, this statement means that the distance between the developer inlet 30 and outlet 40 of the developer container 22, measured in the direction opposite to the developer conveyance direction, is shorter than the distance between the developer inlet 30 and outlet 40 of the developer container 22, measured in the same direction as the developer conveyance direction. The distance between the developer inlet 30 and outlet 40 of the developer container 22, measured in the direction opposite to the developer conveyance direction is desired to be as short as possible.

As described above, the distance from the developer outlet 40 to the developer inlet 30 in terms of the developer conveyance direction is desired to be as long as possible. Therefore, there is a limit to the speediness with which the supplied replenishment developer is discharged. Therefore, it is impossible to keep the amount of the fluctuation of (A–B) in the developer container 22 below a certain value.

On the other hand, even if the distance from the developer inlet 30 to the developer outlet 40 in terms of the developer conveyance direction is substantial, the excess amount of the developer in the developer container 22 can be relatively quickly discharged by improving the developer in fluidity. However, in order to virtually instantly discharge the excess amount of developer, the developer fluidity must be raised to the vicinity of the fluidity of liquid. But, raising the developer fluidity to the vicinity of the fluidity of liquid results in another problem that toner will leak and/or scatter through the developer seal portion of the developing apparatus 4. This also makes it virtually impossible to keep the amount of the fluctuation of (A–B) in the developer container 22, below a certain value. The developer fluidity is desired to be in the following range, which will be described next.

To evaluate the developer fluidity in terms of angle of repose, the angle of repose of the developer in the developing apparatus 4 needs to be in the range of 20°–70°, preferably, 30°–60°, more preferably, 35°–50°.

When the angle of repose is below 20°, the developer is too high in fluidity. Therefore, such problems as the leaking and/or scattering of toner occur. On the contrary, when the angle of repose is higher than 70°, the developer is too low in fluidity. Therefore, the developer fails to be efficiently discharged and/or the supplied replenishment toner fails to be satisfactorily stirred, which makes it impossible to solve the problems with which the present invention is concerned.

Further, it is also desired that the fluidity of the replenishment developer falls in a specific range; in terms of angle of repose, it is desired to be in the range of 10°–70°. If the angle of repose of the replenishment developer is no more than 10°, the phenomenon that the freshly supplied replenishment developer slides on the top surface of the body of the pre-existing developer in the developer container 22, failing thereby to be sufficiently stirred, occurs. On the other hand, if it is higher than 70°, the freshly supplied replenishment developer fails to be satisfactorily mixed with the developer in the developing apparatus 4, resulting in the stirring failure. In other words, even from the standpoint of this problem, it is unacceptable to keep the fluidity of the replenishment developer below a specific value.

Figure 5:
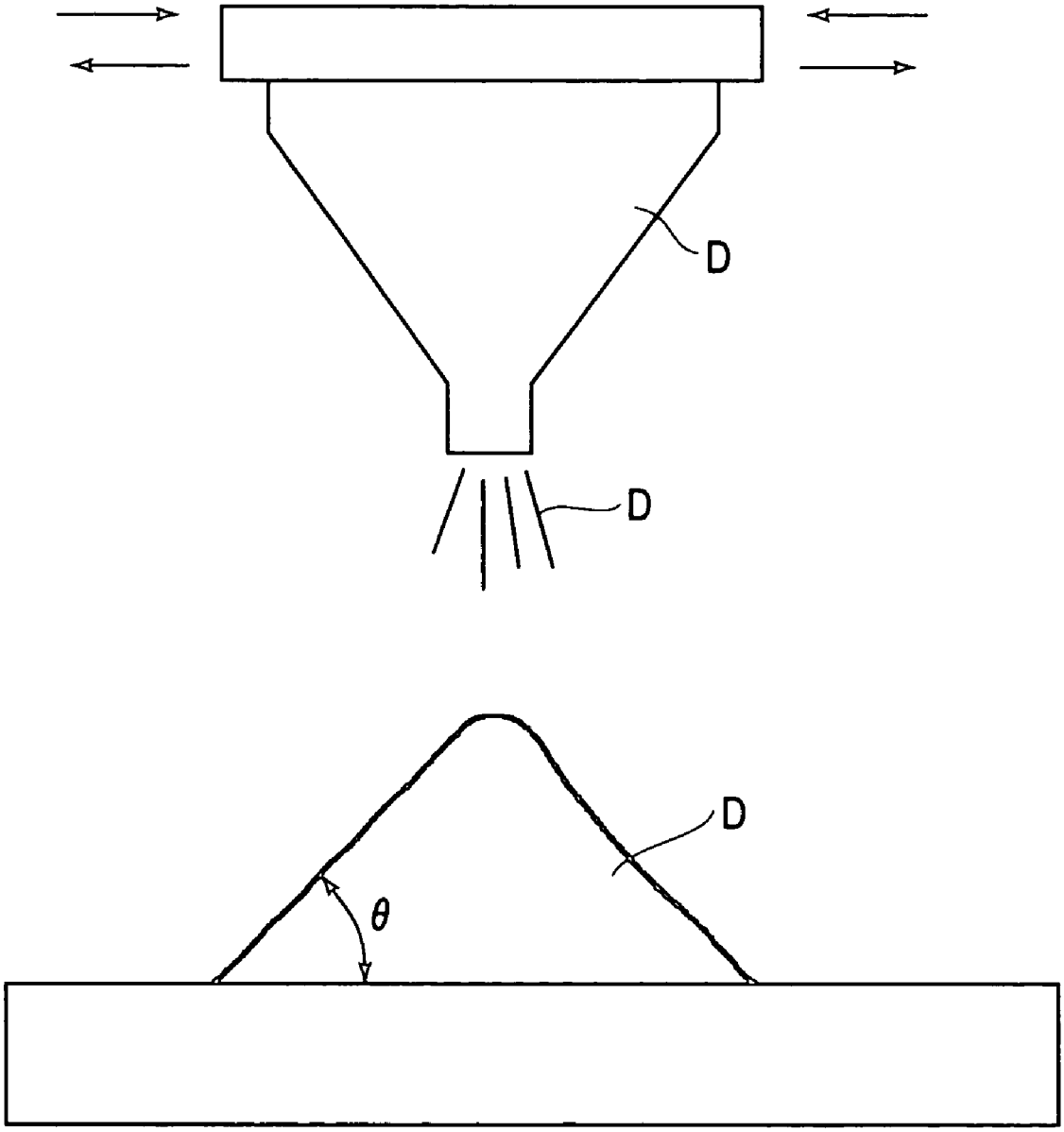
FIG. 5 is a schematic drawing depicting the method for measuring the angle of repose.

Incidentally, referring to FIG. 5, the angle of repose of the developer means the angle of the bottom portion of a conic pile which forms as the developer D is let fall, that is, the angle θ in the drawing. When the angle of repose of the developer D is no more than this angle θ, it does not occur that the developer D keeps sliding downward. As has been well-known, developer high in fluidity is small in angle of repose, whereas developer low in fluidity is high in angle of repose.

The angle of repose of the developer can be measured using the following method, for example.

The vibration table of a Powder Tester (Hosokawa Micron Co., Ltd.: Model PT-N) is fitted with a sieve which is 246 μm in eye size. Then, 250 cc of the test sample is placed in the sieve, and is vibrated for 180 seconds. Then, the angle of repose of the toner pile having formed on the angle of repose measurement table is measured with the use of an angle measurement arm.

The value of (A−B)/A can be reduced by reducing the amount of the fluctuation of (A−B) in the developer container 22, and the amount of the fluctuation of (A−B) in the developer container 22 can be reduced by adjusting the locations of the inlet 30 and/or outlet 40, or by controlling the fluidity of the developer. However, it can be reduced by increasing the amount of the developer in the developing apparatus 4, because increasing the amount of the developer in the developing apparatus 4 increases the denominator of (A−B)/A. This means that when there is a large amount of developer is in the developing apparatus 4, the position of the top surface of the body of the developer in the developing apparatus 4 does not change much (it is not affected much) by the changes in the amount of the developer in the developing apparatus 4 as long as the changes are small.

However, increasing the amount of the developer in the developing apparatus 4 causes the following problem. That is, not only does it add to the initial cost, but also, it causes the problem that even if a certain amount of deteriorated developer is replaced by the fresh supply of replenishment developer with which the developing apparatus 4 is supplied, the presence of a large amount of developer in the developing apparatus 4 makes it difficult for the benefits of the trickle developing method to be sufficiently realized. Raising the carrier ratio in the replenishment developer elevates the efficiency with which the deteriorated developer is replaced. However, it increases the amount of carrier consumption, which is not desirable from the standpoint of running cost. Further, raising the carrier ratio in the replenishment developer increases the amount by which the developing apparatus 4 is supplied with carrier, which results in the problem that the increase in the amount by which developing apparatus 4 is supplied with carrier increases the amount by which the amount of the developer in the developing apparatus 4 fluctuates.

From the standpoints described above, the amount of the developer, inclusive of toner, in the developing apparatus 4 needs to be kept within the range of 100–2,000 g, preferably, 100–1,500 g, more preferably, 100–1,000 g. The upper limit is determined by the above described reason. As for the bottom limit, it is determined because of the fact that if the amount of the developer in the developing apparatus 4 is smaller than a certain value, the toner density is likely to be easily affected by the amount by which the developing apparatus 4 is supplied with the replenishment developer.

From the above described three standpoints, that is, the positioning of the developer inlet 30 and developer outlet 40, developer fluidity, and amount of the developer in the developing apparatus 4, it is not necessarily desired to reduce (A−B)/A in the developing apparatus 4. That is, it needs to be no less than 0.01.

Embodiments 1–6, and Comparative Samples 1–5

Next, the embodiments of the present invention will be described in detail in comparison to comparative samples. However, the following embodiments of the present invention are not intended to limit the scope of the present invention.

The maximum amount (A) of the developer (mixture of toner and carrier), and the minimum amount (B) of the developer (mixture of toner and carrier), are measured using the following method. The optimal amount for the developer in the developing apparatus 4 changes as the developer changes in apparent density due to the changes in ambience and the like. Therefore, the following methods should be carried out in an environment which is stable in temperature and humidity. In the following embodiments, the methods for measuring the developer amount were carried out in an environment in which temperature was 23.5° C. and humidity was 50%.

Maximum Developer Amount: A

Until the amount by which the developing apparatus 4 is supplied with carrier becomes virtually equal to the amount by which carrier is discharged from the developing apparatus 4, a process in which an image with an image density of 100% is developed is repeated, while repeatedly supplying the developing apparatus 4 with replenishment developer so that the amount by which the developing apparatus 4 is supplied with toner by being supplied with the replenishment developer equals the amount by which the toner in the developing apparatus 4 is consumed by the development. Then, the amount of the developer in the developing apparatus 4 is measured. Here, "image density" means the ratio of the sum of toner covered areas of an image relative to the entirety of the image. For example, in the case of a digital image, image density means the ratio of the sum of the toner covered picture elements of a digital image relative to the total number of picture elements of the digital image. Thus, an image with an image density of 100% means a so-called solid image. Further, "amount by which carrier is supplied", which hereinafter may be referred to simply as carrier supplying speed) and "amount by which carrier is discharged", (which hereinafter may be referred to simply as carrier discharging speed), mean the amount in grams by which carrier is supplied to, or discharged from, the developing apparatus 4 per unit length (minutes) of time. According to the studies by the inventors of the present invention, it may be assumed that as the difference between the carrier supplying and discharging speeds has settled to a value no greater than 5 g/min, the two have become equal in practicality. In order to minimize errors in the measuring of the carrier supplying speed and carrier discharging speed, it is desired that the average values obtained by measuring several times the carrier supplying speed and carrier discharging speed are adopted as the carrier supplying speed and carrier discharging speed, respectively. In this embodiment, the carrier supplying speed and carrier discharging speed became practically equal after the image forming apparatus was used for the cumulative length of time equivalent to the formation of 1,000 A4 copies, and therefore, the amount of the developer in the developing apparatus 4 at that time was measured. Incidentally, if the replenishment developer is relatively low in carrier ratio, it is possible that it will take a substantial length of time for the amount of the developer in the developing apparatus 4 to reach the maximum value. Therefore, when the carrier ratio of the replenishment developer was no more than 10%, the above described development process was repeated for a length of time equivalent to the formation of 2,000 copies, and when the carrier ratio of the developer was no more than 5%, it was repeated for a length of time equivalent to the formation of 3,000 copies. As will be evident from the above explanation, the number of copies to be made until the carrier supplying speed and carrier discharging speed become practically equal are affected by the apparatus structure. Therefore, the length of time the above described development process is to be continued should be set according to the apparatus structure.

After repeating the above-mentioned development process to form a predetermined number of copies, the amount of the developer in the developing apparatus 4 is repeatedly measured with intervals equivalent in length to the formation of 50 copies. In this embodiment, the amount of the developer in the developing apparatus was measured five times, and the average value obtained from the results of the five measurements was adopted as the maximum developer amount A.

Minimum Developer Amount: )

The developer discharging speed, that is, the rate at which the developer is discharged through the developer outlet 40, is measured while repeating the development process without supplying the developing apparatus 4 with replenishment developer. Then, the value of the developer discharging speed, that is, the rate at which the developer is discharged through the developer outlet 40, which is measured as the rate will have fallen to virtually zero, is used as the value for the minimum developer amount B. However, it takes a substantial length of time for the developer discharging speed to fall to absolute zero. Therefore, the value of the developer amount in the developing apparatus 4, which is measured when the developer discharging speed will have fallen to 0.5 g/min is used as the value for the minimum developer amount B. In simple calculation, when the developer discharging speed is 0.5 g/min, the amount of the developer discharged per hour is roughly 30 g. In reality, however, there is the relationship that as the developer is discharged, the developer discharge speed reduces. Therefore, the actual amount of the developer discharged per hour will be roughly 10 g at most. The fluctuation in the vicinity of this value can be ignored. Thus, the speed at which the developer is discharged through the developer outlet was repeatedly measured while repeating the development process in which image density is 0%. Then, the value of the developer amount measured immediately after the average value of five developer discharging speeds consecutively measured became no more than 0.5 g/min, was used as the minimum amount B. Conversely, when carrying out the development process in which image density is 0%, a developing apparatus capable of discharging the developer at a speed no more than 0.5 g/min must be used.

The developing apparatus is to be adjusted in (A−B)/A in the following manner.

It is evident from the above explanation that the carrier discharging speed and carrier supplying speed are related to the changes in the amount of the fluctuation of (A−B) in the developing apparatus 4. Therefore, the developing apparatus can be adjusted in (A−B)/A by controlling at least one among the carrier discharging speed, carrier supplying speed, and maximum amount A of the developer in the developing apparatus.

For example, the developer discharging speed, and the amount of the developer in the developing apparatus, can be adjusted as follows:

The developer outlet 40 in this embodiment is located in the downstream portion of the development chamber 23 of the developing apparatus 4 in terms of the developer conveyance direction, for the following reason.

The most downstream portion of the bottom wall of the development chamber 23 is provided with an opening 12 as a developer passage to the stirring chamber 24. In the adjacencies of the opening 12, the height of the body of the developer relative to the bottom surface of the development chamber 23 is zero. In other words, the portion of the top surface of the body of developer, in the downstream portion of the development chamber 23, is sloped. Next, it will be described how the developer discharging speed and developer amount in the developing apparatus can be adjusted at the same time by positioning the developer outlet 40 in the portion of the development chamber, in which the top surface of the body of developer in the development chamber 23 is sloped.

Figure 6:
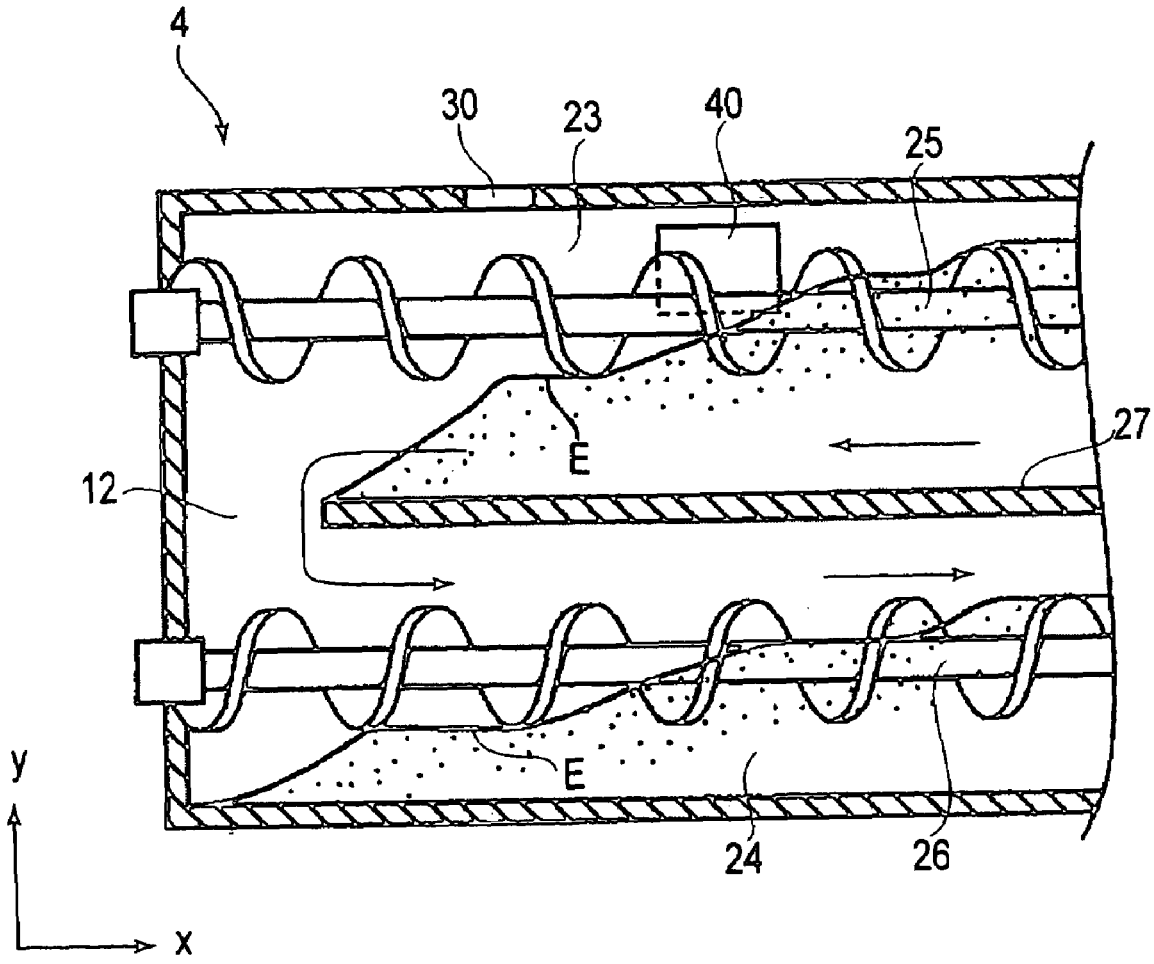
FIG. 6 is an enlarged sectional view of one of the end portions of the developer container, at a plane parallel to its lengthwise direction, depicting the structure of the developer container.

FIG. 6 is a drawing showing the positioning of the developer outlet 40, and shows the set-up in which the developer outlet 40 is located in the downstream portion of the development chamber 23 of the developing apparatus 4 in terms of the developer conveyance direction. In FIG. 6, the top surface E of the body of developer in the developing apparatus 4 is schematically drawn in a thick solid line, showing that the top surface E is sloped. Further, FIG. 6 shows the structural arrangement in which the position of the bottom edge of the developer outlet 40, which is 10 mm in vertical dimension and 10 mm in horizontal dimension, coincides with that of the axial line of the conveyance screw 25 in terms of the vertical direction. In the following portion of the description of the present invention, the position of the developer outlet 40 shown in FIG. 6 will be used as the referential position. The direction parallel to the axial line of the conveyance screw 25 is represented by the x axis, and the direction parallel to the other edge of the developer outlet 40 is represented by the y axis.

Figure 7:
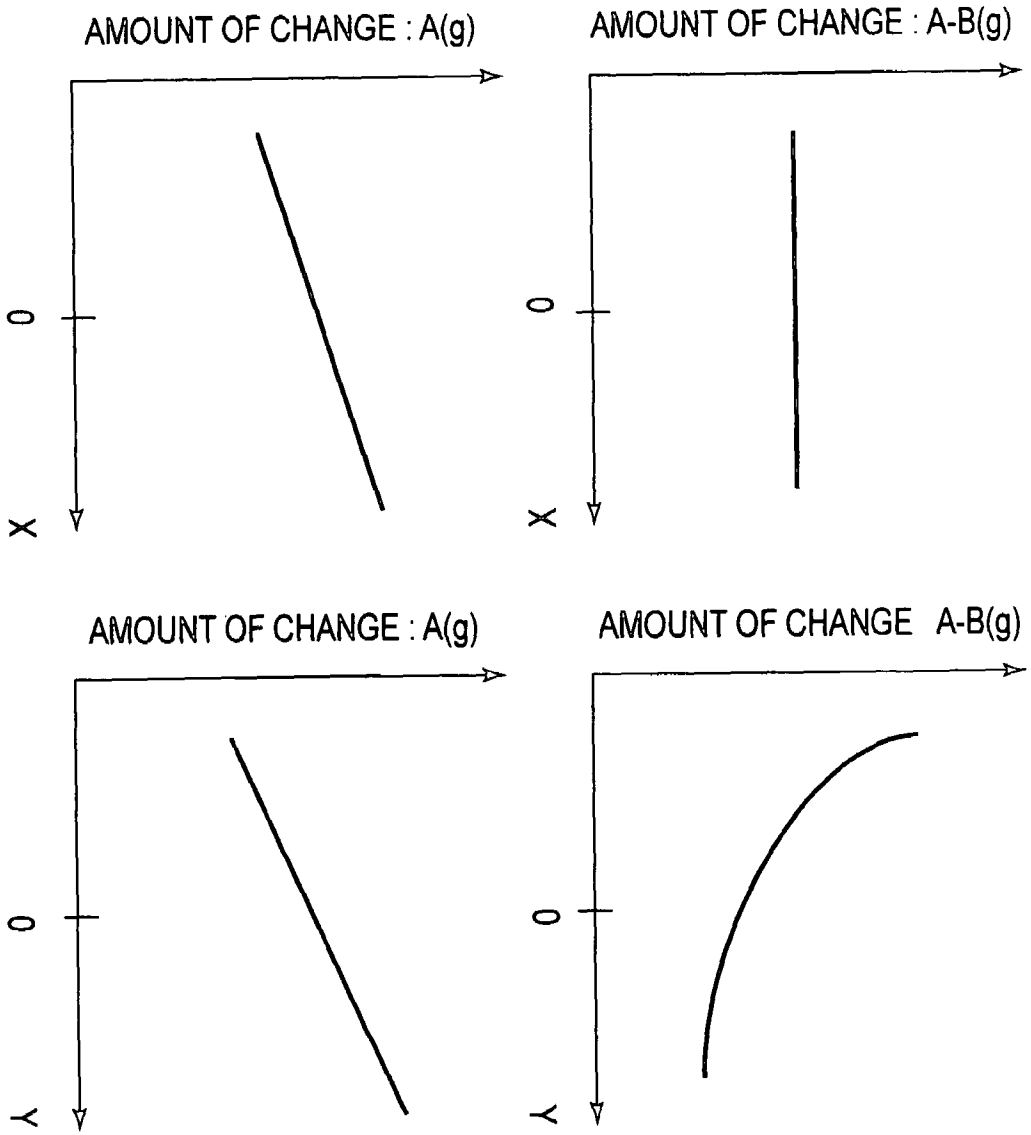
FIG. 7 is a graph showing the relationship among: the changes in the amount of developer; amount of developer; and position of the developer outlet.

In FIG. 7, the values of (A−B)/A obtained by changing the position of the developer outlet 40 in the directions parallel to the x and y axes from the aforementioned referential position are plotted. The following are evident from the results of these measurements.

(A–B) can be reduced by moving the position of the developer outlet 40 upward (+ direction of the y axis), and can be increased by moving the position of the developer outlet 40 in the reverse direction, that is, downward (– direction of the y axis). This is for the following reason.

Placing the developer outlet 40 in the adjacencies of the screw shaft in terms of the vertical direction makes it easier for the developer to be discharged by the force of the spiral blade of the screw 25. Therefore, when the developer outlet 40 is in the adjacencies of the screw shaft, the discharging of the developer continues even after the amount of the developer in the developing apparatus substantially reduces, resulting in the increase in the amount of the fluctuation of (A–B). On the other hand, moving the position of the bottom edge of the developer outlet 40 upward (+ direction of the y axis) from the adjacencies of the screw shaft in terms of the vertical direction increases the distance between the developer outlet 40 and the spiral blade of the screw 25, reducing thereby the amount of force applied to the developer. Therefore, as the amount of the developer in the developing apparatus 4 decreases, the developer discharge stops, resulting in the reduction of the fluctuation in (A–B).

On the other hand, moving the developer outlet 40 in the direction parallel to the x axis does not affect the fluctuation of (A–B), because it does not affect the positional relationship between the developer outlet 40 and conveyance screw 25 in terms of the vertical direction.

It is evident from the above explanation that (A–B) can be adjusted by controlling the developer discharging speed by adjusting the position of the developer outlet 40 in terms of the vertical direction (direction parallel to the y axis), and also, that positioning the developer outlet 40 so that its bottom edge will be positioned higher than the axial line of the screw 25 is effective for reducing the fluctuation of (A–B).

Adjusting the position of the top surface of the body of developer in the developing apparatus means adjusting the amount A of the developer. In this embodiment, however, the developer outlet 40 is positioned in the portion of the developer container, in which the top surface of the body of developer is sloped. Therefore, the amount A of the developer can be changed by moving the developer outlet 40 in the horizontal direction (direction parallel to the x axis). As described above, moving the developer outlet 40 in the horizontal direction has virtually no effect upon the value of (A–B), and therefore, (A–B) and A can be controlled independently from each other to adjust (A–B)/A.

Here, the portion of the development chamber 23 in which the top surface E of the body of developer is sloped is desired to be such a portion of the development chamber 23 in which the arbitrarily selected two consecutive sections of the portion of the development chamber 23, the lengths of which are equivalent to a single pitch of the spiral blade of the screw 25, are different by 1 mm in terms of the average height of the top surface of the body of developer in each sections, more specifically, the average of the heights of the highest and lowest points of the top surface of the body of the developer in each section. Here, the top surface E of the body of developer means the top surface E of the developer in the development chamber 23 having the developer outlet 40. In the case of a developing apparatus such as the developing apparatus in this embodiment in which the development chamber 23 is positioned on top of the stirring chamber 24, the top surface E of the developer in the developing apparatus 4 is inherently sloped. However, even in the case of a developing apparatus in which the top surface of the body of developer is not inherently sloped, the top surface can be easily sloped by making the screw 25 nonuniform in developer conveyance performance, in terms of the direction parallel to the developer conveyance direction, by attaching ribs or the like to certain portions of the screw 25.

Incidentally, even if the developer outlet 40 is positioned in the portion of the development chamber 23 in which the top surface of the body of developer is level, adjustment similar to the above described one can be made by adjusting the width of the developer outlet 40 while adjusting the position of the developer outlet 40 in terms of the vertical direction. However, this adjusting method is more difficult than the above described method. In this case, adjustment can be made by changing the shape of the developer outlet 40. Obviously, the adjustment similar to the above described one can be made even if the developer outlet 40 is positioned in the portion of the developing apparatus, in which the top surface of the body of developer is not level.

The speed at which carrier is supplied can be adjusted as follows:

As described above, it is when the carrier discharging speed is highest that the developer amount in the developing apparatus becomes largest. In other words, it is when the speed at which the developing apparatus is supplied with carrier by the supplying of the developing apparatus with replenishment developer is highest that the developer amount in the developing apparatus becomes largest.

Even when the amount by which the replenishment developer is supplied is kept constant, the amount by which carrier is supplied changes as the carrier ratio in weight in the replenishment developer is changed. That is, increasing the carrier ratio in the replenishment developer increases the amount A, whereas decreasing the carrier ratio in the replenishment developer reduces the amount A. The minimum amount B is not affected by the carrier ratio in the replenishment developer. Therefore, raising the carrier ratio increases the fluctuation of (A–B), whereas lowering the carrier ratio reduces the fluctuation of (A–B).

However, even if the carrier ratio in the replenishment developer is reduced to reduce the fluctuation of (A–B), the effects of the trickle developing method sometimes do not materialize.

In the first place, the trickle developing method is a developing method in which developer is rejuvenated as much as possible by gradually supplying the developing apparatus with a small amount of carrier while supplying the developing apparatus with toner to compensate for the toner consumed for image formation. Thus, if the replenishment developer is reduced in carrier ratio, and the amount by which the developing apparatus is supplied with toner remains the same, the amount by which the carrier in the developing apparatus is replaced by the fresh supply of carrier becomes smaller. Therefore, the effects of the trickle developing method are less likely to be realized. Thus, the carrier ratio in the replenishment developer is desired to be no less than 3%, preferably, no less than 5%, in weight (carrier weight/replenishment developer weight). On the other hand, increasing the weight ratio of the carrier to 40% or more makes the fluctuation of (A–B) too large. Therefore, the weight ratio of the carrier relative to the toner in the replenishment developer is desired to be no more than 40%, preferably, 30%, more preferably, 20%. Regarding the same matter, the carrier supplying speed is desired to be no more than 25 g/min, preferably, 15 g/min, more preferably, 10 g/min. However, reducing the carrier supplying speed to a value no more than 1 g/min makes it difficult to materialize the effects of the trickle developing method.

The developer supplying speed, that is, carrier supplying speed, can also be adjusted as follows:

The amount of the developer required by an image forming apparatus for development is sometimes different from that required by another image forming apparatus, because of the difference between the two apparatuses in the "covering power" of toner, fixing apparatus structure, and the like factors, even if the two images formed by the two apparatuses, one for one, ate both 100% in image density. In other words, if one of the two apparatuses is smaller in the amount of the toner consumed when the image density is 100% than the other, the former can be smaller in the amount by which it needs to be replenished with toner, being therefore smaller in the amount by which it needs to be replenished with carrier, than the latter. In other words, the carrier supplying speed can be adjusted based on the above described observation.

The fluctuation of (A−B) can be reduced by setting the amount per unit area by which toner is borne on the peripheral surface of the photosensitive drum 1 when the image density is 100%, to a value no more than 0.85 $mg/cm^2$, preferably, 0.7 $mg/cm^2$. However, if it is set to a value no more than 0.3 $m/cm^2$, toner is nonuniformly coated, resulting in the formation of an image nonuniform in density. Thus, it is desired to be set to a value no less than 0.3 $mg/cm^2$, preferably 0.4 $mg/cm^2$.

Described next in detail are various embodiments of the present invention.

Embodiment 1

Images were formed with the use of an image forming apparatus employing a developing apparatus structured as shown in FIG. 6, using a replenishment developer, the carrier ratio in weight of which is 20%, with the position of the developer outlet 40 relative to the aforementioned referential position set so that the x=0 mm and y=0 mm. (A−B) was 60 g, and A was 600 g. Therefore, (A−B)/A was 0.100.

Embodiment 2

Images were formed with the use of an image forming apparatus employing a developing apparatus structured as shown in FIG. 6, using a replenishment developer, the carrier ratio in weight of which is 20%, with the position of the developer outlet 40 relative to the referential position set so that x=0 mm and y=2 mm. (A−B) was 50 g, and A was 650 g. Therefore, (A−B)/A was 0.077.

Embodiment 3

Images were formed with the use of an image forming apparatus employing a developing apparatus structured as shown in FIG. 6, using a replenishment developer, the carrier ratio in weight of which is 20%, with the position of the developer outlet 40 relative to the referential position set so that x=−3 mm and y=0 mm. (A−B) was 60 g, and A was 700 g. Therefore, (A−B)/A was 0.086.

Embodiment 4

Images were formed with the use of an image forming apparatus employing a developing apparatus structured as shown in FIG. 6, using a replenishment developer, the carrier ratio in weight of which is 20%, with the position of the developer outlet 40 relative to the referential position set so that x=−3 mm and y=2 mm. (A−B) was 50 g, and A was 600 g. Therefore, (A−B)/A was 0.083.

Embodiment 5

Images were formed with the use of an image forming apparatus employing a developing apparatus structured as shown in FIG. 6, using a replenishment developer, the carrier ratio in weight of which is 10%, with the position of the developer outlet 40 relative to the referential position set so that x=0 mm and y=0 mm. (A−B) was 40 g, and A was 580 g. Therefore, (A−B)/A was 0.068.

Embodiment 6

Images were formed with the use of an image forming apparatus employing a developing apparatus structured as shown in FIG. 6, using a replenishment developer, the carrier ratio in weight of which is 20%, with the position of the developer outlet 40 relative to the referential position set so that x=0 mm and y=0 mm. However, the developing apparatus was the same in shape, but was larger. Thus, A was 1,000 g, and (A−B) was 50 g. Therefore, (A−B)/A was 0.050.

Embodiment 7

Images were formed with the use of an image forming apparatus employing a developing apparatus structured as shown in FIG. 6, using a replenishment developer, the carrier ratio in weight of which is 10%, with the position of the developer outlet 40 relative to the referential position set so that x=−4 mm and y=3 mm. The developing apparatus was larger, as it was in Embodiment 6. Thus, A was 1,500 g, and (A−B) was 20 g. Therefore, (A−B)/A was 0.013.

Embodiment 8

The developing apparatus in this embodiment was the same in structure as that in Embodiment 6. However, the developer in this embodiment was 30° in angle of repose, whereas the angle of repose of the developers in the first to seventh embodiments were 40°. In other words, the developer in this embodiment was superior in fluidity, being therefore superior in dischargeability. As a result, (A−B) was 20 g and A was 1,000 g. Therefore, (A−B)/A was 0.020.

Comparative Sample 1

Images were formed with the use of an image forming apparatus employing a developing apparatus structured as shown in FIG. 6, using a replenishment developer, the carrier ratio in weight of which is 20%, with the position of the developer outlet 40 relative to the referential position set so that x=0 mm and y=−2 mm. (A−B) was 100 g, and A was 550 g. Therefore, (A−B)/A was 0.182.

Comparative Sample 2

Images were formed with the use of an image forming apparatus employing a developing apparatus structured as shown in FIG. 6, using a replenishment developer, the carrier ratio in weight of which is 20%, with the position of the developer outlet 40 relative to the referential position set so that x=2 mm and y=0 mm. (A−B) was 60 g, and A was 550 g. Therefore, (A−B)/A was 0.109.

Comparative Sample 3

Images were formed with the use of an image forming apparatus employing a developing apparatus structured as shown in FIG. 6, using a replenishment developer, the carrier ratio in weight of which is 20%, with the position of the developer outlet 40 relative to the referential position set so that x=−3 mm and y=−2 mm. (A−B) was 50 g, and A was 550 g. Therefore, (A−B)/A was 0.183.

Comparative Sample 4

Images were formed with the use of an image forming apparatus employing a developing apparatus structured as shown in FIG. 6, using a replenishment developer, the carrier ratio in weight of which is 40%, with the position of the developer outlet 40 relative to the referential position set so that x=0 mm and y=0 mm. (A–B) was 100 g, and A was 640 g. Therefore, (A–B)/A was 0.156.

Comparative Sample 5

Images were formed with the use of an image forming apparatus employing a developing apparatus structured as shown in FIG. 6, using a replenishment developer, the carrier ratio in weight of which is 40%, with the position of the developer outlet 40 relative to the referential position set so that x=0 mm and y=0 mm. The developing apparatus was the same in shape as those in the preceding embodiments, but was smaller. Thus, A was 300 g, and (A–B) was 40 g. Therefore, (A–B)/A was 0.200.

Comparative Sample 6

Images were formed with the use of an image forming apparatus employing a developing apparatus structured as shown in FIG. 6, using a replenishment developer, the carrier ratio in weight of which is 10%, and which is 15° in angle of repose, being therefore excellent in fluidity, with the position of the developer outlet 40 relative to the referential position set so that x=−4 mm and y=−3 mm. The developing apparatus was the same (larger) as that used in Embodiment 6. Thus, A was 1,500 g and (A–B) was 10 g. Therefore, (A–B)/A was 0.007.

Comparative Sample 7

Images were formed with the use of an image forming apparatus employing a developing apparatus structured as shown in FIG. 6, with the position of the developer outlet 40 relative to the referential position set so that x=−4 mm and y=3 mm. However, the developing apparatus was the same as that in Embodiment 6, being therefore was larger. Thus, A was 1,500 g. Further, a replenishment developer, the carrier ratio in weight of which is 4%, was used. Therefore, (A–B) was 10 g. Therefore, (A–B)/A was 0.007.

Table 1 given below shows the results of the tests carried out to examine the above listed first to eight embodiments of the present invention, and first to seventh comparative samples, in terms of the nonuniformity in image density. In each test, an image with an image density of 100% was formed after 1,000 recording papers of A4 size were run through the image forming apparatus, with the image density set to 0%. The meanings of the referential symbols in the table are given below the table.

TABLE 1

| | A − B (g) | A (b) | (A − B)/A (g) | |
|---|---|---|---|---|
| Emb. 1 | 60 | 600 | 0.100 | F |
| Emb. 2 | 50 | 650 | 0.077 | G |
| Emb. 3 | 60 | 700 | 0.086 | G |
| Emb. 4 | 50 | 600 | 0.083 | G |
| Emb. 5 | 40 | 580 | 0.068 | G |
| Emb. 6 | 60 | 1000 | 0.050 | G |
| Emb. 7 | 20 | 1500 | 0.013 | G |
| Emb. 8 | 20 | 1000 | 0.020 | G |

TABLE 1-continued

| | A − B (g) | A (b) | (A − B)/A (g) | |
|---|---|---|---|---|
| Comp. 1 | 100 | 550 | 0.182 | N |
| Comp. 2 | 60 | 550 | 0.109 | N |
| Comp. 3 | 100 | 700 | 0.142 | N |
| Comp. 4 | 100 | 640 | 0.156 | N |
| Comp. 5 | 60 | 300 | 0.200 | N |
| Comp. 6 | 10 | 1500 | 0.007 | N |
| Comp. 7 | 10 | 1500 | 0.007 | G |
| | | | in carrier deterioration = N | |

G: No Problem
F: Practical
N: Problematic

As will be evident from the above explanation and Table 1, according to the present invention, the formation of an image nonuniform in image density, which is attributable to the tribo fluctuation resulting from insufficient stirring of developer and/or nonuniform stirring, can be avoided by keeping in a predetermined range, the ratio of the amount of the fluctuation of the developer in the developing apparatus, to the maximum amount of the developer in the developing apparatus, by adjusting one factor among the amount by which the developing apparatus is supplied with carrier, amount by which carrier is discharged from the developing apparatus, and amount of developer in the developing apparatus.

However, improving the developer in fluidity to improve the developer in dischargeability so that (A–B)/A will be reduced to a value smaller than 0.01 makes the developer too high in fluidity for it to be sufficiently mixed with the developer in the developing apparatus, being therefore likely to result in the formation of an image nonuniform in density. It also is likely to cause other problems, namely, the problems that an image forming apparatus is easily affected by the nonuniformity in the process of supplying the developing apparatus with replenishment developer, and that toner (developer) leaks.

On the other hand, if (A–B)/A is reduced to a value no more than 0.1 by reducing the carrier ratio in the replenishment developer while increasing the amount of the developer in the developing apparatus, the image forming apparatus remains at an acceptable level in terms of the nonuniformity in image density. In this case, however, the amount by which the developing apparatus is supplied with a fresh supply of carrier is relatively smaller in spite of the increased amount of the developer in the developing apparatus. Therefore, the effect of the trickle developing method in reducing the carrier deterioration is not sufficiently realized, allowing thereby the deteriorated carrier to remain longer in the developing apparatus.

When the developer amount A is small while the amount by which the developing apparatus is supplied with carrier is large (carrier ratio in replenishment developer is high), the deteriorated carrier in the developer in the developing apparatus is smoothly replaced by the fresh supply of carrier. Therefore, the deteriorated carrier is not likely to remain a long time in the developing apparatus. In other words, the greater the (amount by which carrier is supplied)/A, the smaller the amount by which the deteriorated carrier remains in the developing apparatus. Here, the condition in which the amount by which carrier is supplied is large coincides with the condition in which (A–B) is large. Therefore, it is evident that there is no small relationship between the index (A–B)/A and the length of the stagnation of the deteriorated carrier in the developing apparatus. Therefore, unless an arrangement is made to keep (A–B)/A above a certain value, the effect of preventing the deteriorated carrier from stagnating in the developing apparatus cannot be realized. That is, it is necessary to make an arrangement so that (A–B)/A will become no less than 0.01.

Embodiment 2

An full-color image forming apparatus such as that in the first embodiment employs a plurality of developing apparatuses. Thus, in order to share common components from the standpoint of cost reduction, it is common practice to make identical in structure the plurality of developing apparatuses different in developer color. Even when they are made different in structure, the differences are minute, because they are provided just for preventing a service person and/or a user from misidentifying the individual developing apparatuses, or the like purpose. In other words, they are virtually identical in structure, with respect to the developer container 22, conveyance screw 25, and developer outlet 40. Further, even when it is impossible to make all of the plurality of developing apparatuses identical in structure for sharing common components, it is a frequently used practice to make as many developing apparatuses 4 as possible share common components.

However, making the plurality of developing apparatuses different in developer color identical in structure sometimes results in the following problems.

That is, developer fluidity affects the speed at which developer is discharged, or the like factors. Therefore, if two developing apparatuses are substantially different in the fluidity of the developer they use, the two apparatuses become quite different in the amount of the fluctuation of (A–B) and developer amount A, even if the two apparatuses are identical except for the fluidity of the developer they use.

Therefore, if the four developing apparatuses of a full-color image forming apparatus are identical in structure, and of the four developers, that is, black, cyan, magenta, and yellow developers, which the full-color image forming apparatus uses, only the black developer is reduced in fluidity by changing it in carrier particle diameter, only the developing apparatus for the black color substantially changes in (A–B) and A, which sometimes puts the developing apparatus for the black color in the situation in which the value of (A–B)/A falls outside the acceptable range.

Not only is the above described problem likely to occur when the developer changes in fluidity because carrier is changed in particle diameter, but also, when the developer changes in fluidity because carrier is changed in core, or coating, and/or because toner is changed in particle diameter, type and/or amount of external additive.

As for the countermeasure against the above described problem, all that is necessary is to adjust the developer outlet 40 in position according to development fluidity.

Figure 8:
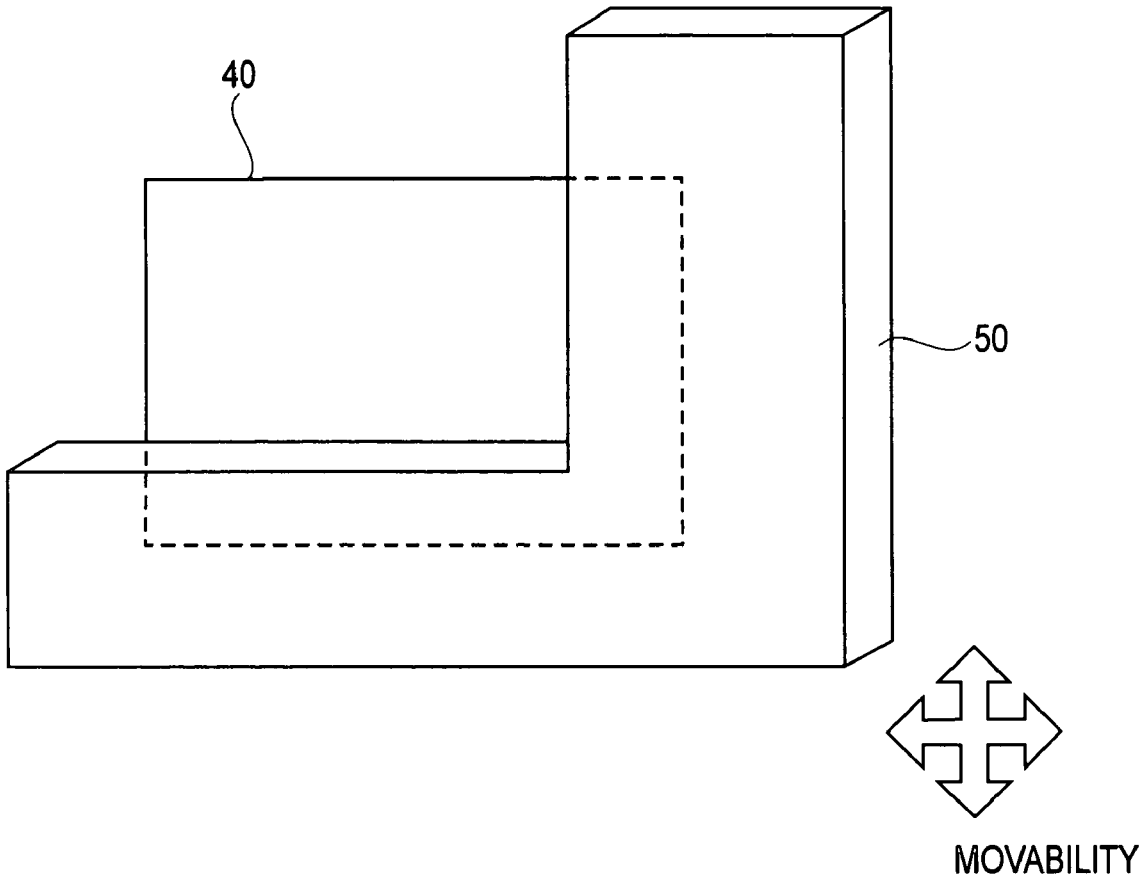
FIG. 8 is an enlarged view of the developer outlet of the developing apparatus in another embodiment of the present invention.

In this case, the plurality of developing apparatuses do not need to be individually made so that they become different in the position of the developer outlet 40. That is, the plurality of developing apparatuses may be identical, being provided with a relatively large opening 40 as the developer outlet 40, and an outlet size adjusting member 50, in the form of a reversely positioned letter L, for adjusting the developer outlet 40 in position, as shown in FIG. 8. With the employment of this method, the plurality of developing apparatuses can be made identical in components, although the component count increases by one. Therefore, the problem can be solved without incurring a large cost increase.

In principle, all that is necessary is to adjust, in the position of the developer outlet 40, only the developing apparatus 4, the (A–B)/A of which has fallen outside the desired range due to the changes in developer fluidity. However, even if none of the developing apparatuses fall outside the desired range in terms of the value of (A–B)/A, adjusting them according to developer fluidity is recommended because the adjustment stabilizes the developing apparatus (image forming apparatus) in image density.

Further, the developing apparatuses may be adjusted by modifying the conveyance screw 25 to adjust the position of the top surface E of the body of developer in the development chamber 23, in the adjacencies of the developer outlet 40.

Further, the amount of the developer in the developer container 22 may be adjusted by modifying the developer container 22.

As for another adjusting method, the replenishment developer may be adjusted in the carrier ratio in weight therein.

Further, the above described adjustment methods may be employed in combination.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 093860/2004 filed Mar. 26, 2004, which is hereby incorporated by reference.

What is claimed is:

1. A developing apparatus for developing an electrostatic image formed on an image bearing member with toner, said apparatus comprising:

a developing container for containing a developer including toner and carrier, said developing container being partitioned by a partition wall into a first chamber and a second chamber, wherein said first chamber and said second chamber are in fluid communication with each other at opposite end portions thereof;

a first feeding member, provided in said first chamber, for feeding the developer within said developing container;

a second feeding member, provided in said second chamber, for feeding the developer in a direction opposite a feeding direction of said first feeding member;

a developer carrying member for carrying the developer to a position where said developer carrying member is opposed to said image bearing member;

supplying means for supplying a developer including toner and carrier into said first chamber through a supply opening;

supply controlling means for controlling a supplying operation of said supplying means to control a toner content of the developer in said developing container, a discharging outlet, provided in said first chamber, for discharging an excessive part of the developer in said developing container resulting from a supplying operation of said supplying means to an outside of said developing container;

wherein said discharging outlet is disposed upstream of said supply opening with respect to the developer feeding direction of said first feeding member;

an amount of the developer in said developing container is 100–2000 (g), an angle of rest of the developer in said developing container is 20–70 (°), wherein when said developing apparatus develops an electrostatic image having an image density of 100(%), an amount A (g) of the developer in said developing container at the time when a difference between a carrier supply amount per unit time by said supplying means and a carrier discharging amount per unit time through the discharging outlet becomes 5 (g/min) or less, and an amount B (g) of the developer in said developing container at the time the carrier discharging amount per unit time becomes 0.5 (g/min) or less when said developing apparatus operates without supply of the carrier by said supplying means, satisfy:

$$0.01 \leqq (A-B)/A \leqq 0.10.$$

2. An apparatus according to claim 1, wherein the operation of said developing apparatus without the supply of the carrier by said supplying means occurs when said developing apparatus develops an electrostatic image having an image density of 0%.

3. An apparatus according to claim 1, wherein a weight amount ratio of the carrier in the supply developer is 3–40(%).

4. An apparatus according to claim 1, wherein a maximum supply amount of the carrier in the supply developer supplied by said supplying means per unit time is 1–25 (g/min).

5. An apparatus according to claim 1, wherein an amount of the toner, per unit area, on said image bearing member is 0.3–0.8 ($mg/cm^2$) when the electrostatic image having the image density is 100%.

6. An apparatus according to claim 1, further comprising a discharging outlet adjustment member for changing a size of the discharging outlet by partly covering the discharging opening.

7. An apparatus according to claim 1, wherein said first chamber is disposed above said second chamber.

* * * * *

UNITED STATES PATENT AND TRADEMARK OFFICE

CERTIFICATE OF CORRECTION

PATENT NO. : 7,231,154 B2
APPLICATION NO. : 11/087514
DATED : June 12, 2007
INVENTOR(S) : Tomoyuki Sakamaki It is certified that error appears in the above-identified patent and that said Letters Patent is hereby corrected as shown below:

COLUMN 10

Line 45, “the falls” should read --the developer falls--; and “developer” (second occurrence) should be deleted.

COLUMN 15

Line 25, “let fall,” should read --allows to fall--.

COLUMN 21

Line 9, “ate” should read --are--.

COLUMN 22

Line 33, “were” should read --was--.

COLUMN 23

Line 43, “was” should be deleted.

COLUMN 25

Line 7, “An” should read --A--.

Signed and Sealed this

Eighteenth Day of March, 2008

JON W. DUDAS
*Director of the United States Patent and Trademark Office*